United States Patent [19]

Stahlecker

[11] 4,055,942

[45] Nov. 1, 1977

[54] METHOD FOR PIECING A THREAD ON OPEN-END SPINNING UNITS

[75] Inventor: Fritz Stahlecker, Bad Uberkingen, Germany

[73] Assignees: Fritz Stahlecker; Hans Stahlecker, Germany

[21] Appl. No.: 655,853

[22] Filed: Feb. 6, 1976

[30] Foreign Application Priority Data

Feb. 19, 1975 Germany ..... 2507153

[51] Int. Cl.[2] ..... D01H 15/00

[52] U.S. Cl. ..... 57/156; 57/58.95; 57/78

[58] Field of Search ..... 57/58.89, 58.91, 58.95, 57/34 R, 78, 156

[56] References Cited

U.S. PATENT DOCUMENTS

| | | | |
|---|---|---|---|
| 3,695,022 | 10/1972 | Landwehrkamp | 57/58.95 X |
| 3,698,174 | 10/1972 | Boucek et al. | 57/58.95 |
| 3,760,576 | 9/1973 | Le Chatalier et al. | 57/58.89 X |

*Primary Examiner*—Richard C. Queisser
*Assistant Examiner*—Charles Gorenstein
*Attorney, Agent, or Firm*—Craig & Antonelli

[57] ABSTRACT

In piecing a thread, it is important for each piecing operation to be performed under uniform conditions. In order to provide uniform conditions for the area of the fibre feed, the fibre tuft offered to the opening means is trimmed in a certain manner, which is then the same for every piecing operation, before the sliver feed is switched on.

18 Claims, 3 Drawing Figures

METHOD FOR PIECING A THREAD ON OPEN-END SPINNING UNITS

Figure 1:
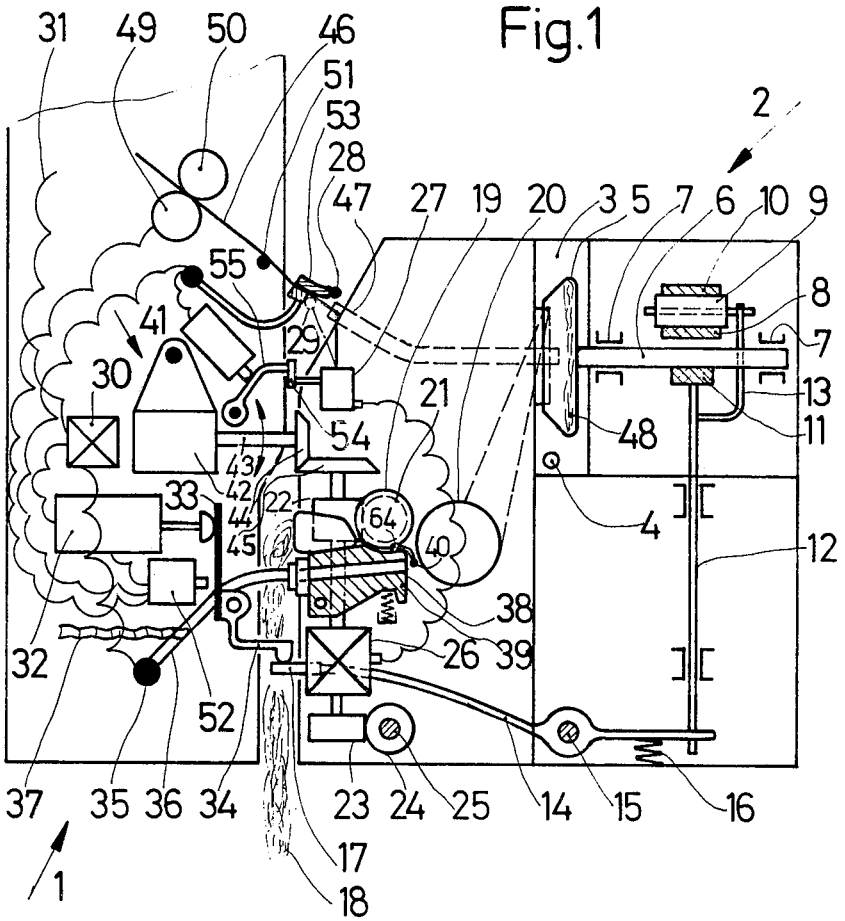

The present invention relates to a method and apparatus for piecing a thread on open-end spinning units.

In the event of a thread break on an open-end spinning unit, it is the usual practice to interrupt the sliver feel while the opening means, in particular an opener roller provided for this purpose, continue to run without interruption, If, in this case, the spinning rotor is braked, the fibres reaching the spinning rotor after the thread break are sucked away and removed through an underpressure line, as they are no longer retained in the collecting channel of the spinning rotor by centrifugal force. The open-end spinning machines are switched off in a corresponding manner: First the sliver feed is interrupted and then the spinning rotor is stopped. The opener roller continues to run for a certain period of time thereafter. The purpose of this is to ensure that a certain quantity of fibres is contained in the spinning rotor for the subsequent piecing operation. It is known practice to interrupt the sliver feed by opening a clutch driving a supply roller (German Disclosed Patent Application No. 2,238,610), by trapping the sliver before it enters the supply means (German Published Patent Application No. 1,957,014), or by swivelling the entire sliver supply means away from the opener roller (German Disclosed Patent Application No. 2,134,342). In all cases, after interruption of the feed, the sliver, offered to the opener roller in the form of a fibre tuft and also offered to the supply roller, is combed and drawn out to a greater or lesser extent. Prior to piecing, the interruption of the sliver feed is eliminated at a given time. In this connection, it is also known practice (German Disclosed Patent Application No. 2,118,775) to equip a travelling piecing unit with an auxiliary drive, which drives the means for feeding the sliver of the corresponding spinning unit, and controls the supply during the piecing operation.

It has already been noted in actual practice that the amount of sliver fed during the piecing operation greatly influences the quality of the piecing point. For this reason, it has already been proposed (German Patent Application No. P 23 60 296.2) that the quantity of fibres fed be matched to the speed of the spinning rotor during the piecing operation. However tests have shown that in spite of matching the feed, the piecing points provided thereby still are of differing appearance and varying strength, with these difficulties occurring both in the case of repeated piecing on the same spinning unit and spinning points on different spinning units.

It is the object of the present invention to create a method and apparatus for piecing a thread on open-end spinning units through which the quality of the piecing points, with respect to their appearance and strength, can be improved and made uniform. This object is solved by a method in which a thread is returned to a spinning rotor, placed on a ring of fibres deposited in the spinning rotor, and then drawn off again, whereby the ring of fibres is formed from fibres removed from an opened sliver and whereby the sliver is offered to opening means by the feed means in the form of a fibre tuft, and whereby the feed means are switched on again for producing the ring of fibres after previously having been switched off, and whereby the fibre tuft has been shortened to a given dimension prior to switching on the means for feeding the sliver.

The present invention is based upon the realization that the fibre feed required for the piecing operation not only depends upon the nature of the actuation and restarting of the feed means but, to a great extent, on the condition of the fibre tuft offered to the opener roller as well. If, for example, the fibre tuft has been very heavily combed after a relatively long standstill period of a spinning unit, the quantity of fibres then fed is clearly different than in a case in which, for example, a first piecing attempt has failed and a new piecing operation is performed again after only a brief interruption of the fibre feed. Shortening the fibre tuft ensures that, irregardless of the length of the standstill period, a largely comparable fibre tuft is provided for each and every piecing operation, which therefore ensures largely identical conditions with respect to the sliver feed in every piecing operation. In this connection, it has been found, in a surprising manner, that shortening the length of the fibres in the fibre tuft has not proven to be a disadvantage, but much rather an advantage. First of all, in rotor spinning the fibre length has much less significance with respect to the strength of the yarn than in the case of a ring spinning machine, for example, so that shortened fibres present relatively little problems. However, on the other hand, they provide significant advantages in connection with placing the end of the thread on the ring of fibres deposited in the collecting channel of the spinning rotor. During this operation, the ring of fibres is ripped open by the thread at one point, whereby it can be observed that irregularities can result at this point through so-called fibre bridges. These bridges are all the more clearer the longer the fibres forming the ring of fibres. The shorter fibres, on the other hand, permit the ring of fibres to be ripped open with much less trouble, thereby significantly improving the appearance and quality of the piecing point.

In order to be able to utilize the advantage of shortened fibres especially well, it is further proposed that the means for feeding the sliver be switched on in two stages, with the shortened fibres, produced by shortening the fibre tuft, from which the ring of fibres is formed being fed during the first stage, followed by fibres of normal length being fed during the second stage. This ensures that there are generally only shortened fibres when the end of the thread is placed on the ring of fibres and the ring of fibres is then ripped open. In actual practice, there is a transition between the two feed stages, thereby providing a uniform piecing point. In this connection, it should be ensured that the shortened fibres are retained securely enough in the collecting channel by means of a suitable spinning rotor speed.

The method is performed by means of an open-end spinning machine comprising spinning units containing means for feeding a sliver, which offer the sliver to opening means in the form of a fibre tuft, the means for supplying the sliver being followed by means for separating and shortening the fibre tuft. In this connection, it is especially advantageous for the open-end spinning machine to be equipped with a maintenance unit for performing piecing operations, the maintenance unit being capable of travelling to the spinning units and having actuating means for actuating the means for separating and shortening the fibre tuft at a spinning unit. Preparation of the fibre tuft by the maintenance unit performing the piecing operation does not result in a delay in the entire piecing operation, as this work can be performed simultaneously while the end of the thread is being sought and prepared. It is also possible to have this work performed by a maintenance unit employed for cleaning the open-end spinning units, followed by a maintenance unit which then performs the actual piecing operation.

In an embodiment of the present invention, a blade which can be pushed into the fibre tuft serves as the separating means. This embodiment is especially well suited for open-end spinning units in which drawing means are provided as the opening means, as the space conditions in this case would favour an arrangement of this type.

In another embodiment of the present invention, a compressed air opening serves as the means for separating and shortening the fibre tuft; this opening is directed against the back of the fibre tuft and against an opener roller associated to the fibre tuft. This embodiment provides the advantage that no additional moving mechanical means have to be provided in the area of the spinning unit. If the fibre tuft is pressed into the clothing of the opener roller by the compressed air, the needles or teeth of the clothing act as blades and shorten the fibre tuft to the desired condition within a matter of seconds. The fibre tuft more or less loses its original triangular configuration and becomes almost rectangular which, as tests have shown, is advantageous for the piecing operation. Moreover, the employment of compressed air provides the advantage that the clothing of the opener roller can simultaneously be cleaned with the aid of this compressed air.

Figure 2:
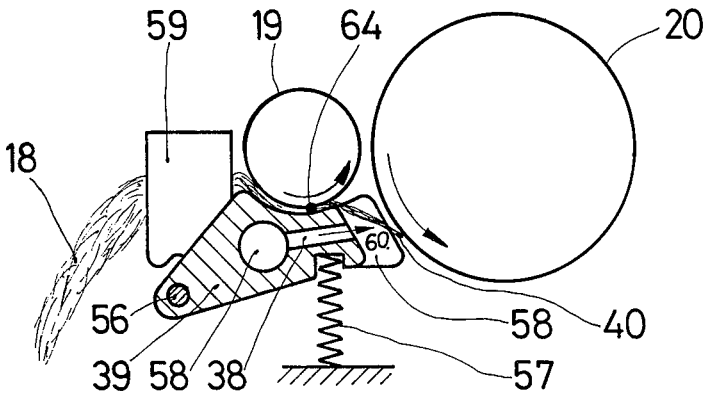
Figure 3:
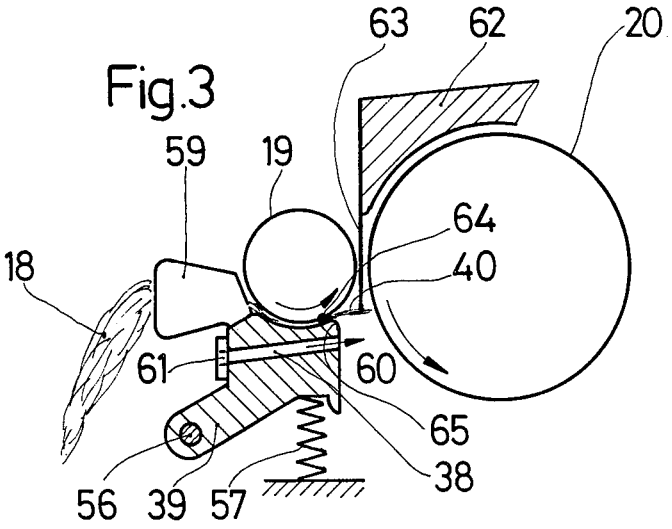

The above discussed and other objects, features and advantages of the present invention will become more apparent from the following description of the practical example, when taken in connection with the drawings, in which FIG. 1 shows a vertical partial section through an open-end spinning machine designed for performing the method according to the present invention; and FIGS. 2 and 3 show embodiments of details of the open-end spinning machine.

Referring now to the drawings, wherein like reference numerals designate like parts throughout the several views, the embodiment illustrated in FIG. 1 incorporates a maintenance unit 1 which travels on unillustrated rails along an open-end spinning machine, of which one spinning point 2 is illustrated schematically as a cross section. Rotating in an underpressure chamber 3, to which an underpressure line 4 is attached, is a spinning rotor 5, whose shaft 6 is mounted in bearings 7 in a housing located therebehind. Shaft 6 is driven by means of a tangential belt, whose bottom line 8 is pressed against shaft 6 by a pressure roller 9 in the operational condition, while its upper line 10 returns over pressure roller 9. In the illustrated brake condition, pressure roller 9 is lifted away from rotor shaft 6 together with the lower line 8 of the tangential belt, whereby rotor shaft 6 is braked by a brake 11. Brake 11 has an actuating rod 12, which is coupled with a lift-off mechanism 13 for pressure roller 9. Actuating rod 12 of brake 11 can be adjusted by means of a double lever 14, which is pivotally mounted about an axle 15. A tension spring 16 acts on double lever 14, said tension spring 16 pulling it into a position which releases shaft 6. The free arm 17 of double lever 14 extends out of spinning unit 2.

Fibres are supplied to spinning rotor 5 in an opened state. To accomplish this, a sliver 18 is caught by a supply roller 19 and offered to an opener roller 20 in the form of a fibre tuft 40. The opened fibres are advanced to spinning rotor 5 from the opener roller, which rotates at a faster speed. Supply roller 19 is driven by means of a shaft 25, extending through the machine longitudinally, via gears 24, 23, 22 and 21, by means of a standing shaft drive. The standing shaft is divided between gears 22 and 23, designed as helical gears, by means of a solenoid clutch 26. Clutch 26 is electrically connected with a switch 27 of a thread stop-motion 28, which switches off clutch 26 in the event of a thread break. In this case, thread stop-motion 28 assumes the dash-dotted position 29.

In maintenance unit 1 for piecing, which is only illustrated schematically, an actuating element, illustrated in the form of a lifting magnet 32, first receives a command to act upon a lever 33 from a control element 30, which is triggered by means of an electrical lead 31 after maintenance unit 1 is positioned at the respective spinning point 2. The above sequence causes a lever 34 connected therewith to be pressed against free arm 17 of double lever 14 of spinning unit 2, thereby braking spinning rotor 5. Moreover, control element 30 is also electrically connected with the drive motor for a shaft 35, by means of which a lever 36 can be swivelled against a stop on supply table 39. Lever 36 is designed in such a manner that it is partially hollow, and is connected with a flexible compressed air line 37 in such a manner that it can permit compressed air to flow into a channel 38 of supply table 39, which operates conjointly with supply roller 19. The compressed air, which is preferably blown into channel 38 of supply table 39 in individual bursts, presses fibre tuft 40 into the clothing of rotating opener roller 20. With the supply interrupted and the sliver trapped on a trapping line 64 between supply roller 19 and supply table 39, the teeth or needles of opener roller 20 act like a blade and shorten fibre tuft 40 to the desired length within seconds. In this connection, it is advantageous for fibre tuft 40 to be separated between supply roller 19 and supply table 39, directly behind trapping line 64, as in this case the individual fibres which are then supplied are especially short. This results in the advantages, explained at the outset, when the thread is placed on the ring of fibres deposited in spinning rotor 5.

Control element 30 then causes an auxiliary drive of maintenance unit 1 to be temporarily coupled with the sliver supply drive of spinning unit 2. In the illustrated embodiment, the auxiliary drive of maintenance unit 1 contains a variable-speed electric motor 42, whose runup is adjustable. A wound-rotor motor with appropriate rheostatic starting circuitry or a variable-speed D.C. motor with smooth starting characteristic can be provided for this purpose. Variable-speed motor 42 drives a shaft 43, which is connected with a driving wheel 44. Shaft 43, carrying driving wheel 44, can be swivelled radially (see double arrow) as far as a counterwheel 45, which is rigidly connected with helical gear 22 of the supply means and which is accessible from the outside. A gear or friction clutch can be arranged between driving wheel 44 and counterwheel 45. The feed of sliver 18 is then switched on for a brief preselected period of time by means of the auxiliary drive of maintenance unit 1, which temporarily causes shortened fibres to be supplied to spinning rotor 5. It is practical to initiate the feed as a factor of the speed of the spinning rotor, which is running up to its operating speed, i.e. to commence at a given speed of rotation, which ensures that the previously fed, shortened fibres are not sucked out of the spinning rotor. This can be performed by means of a contactless tachometer which can be attached to maintenance unit 1.

Maintenance unit 1 picks up a thread end 46 from an unillustrated winding cone and returns it through a yarn removal channel 47 to spinning rotor 5, where it is placed on a ring of fibres 48. Thread end 46 is returned by means of auxiliary draw-off rollers 49 and 50 of maintenance unit 1, of which at least roller 49 can be driven in either sense of direction. Thread end 46 is sucked into spinning rotor 5 by means of the suction in underpressure chamber 3. The reversal of the sense of rotation of auxiliary draw-off roller 49 can be controlled by a thread tension feeler 51 of maintenance unit 1. It is advantageous for the main supply means to be switched on the moment the returned thread end 46 comes into a contacting relationship with ring of fibres 48. In actual practice, this means that there must be an uninterrupted transition from preliminary feed of the shortened fibres to the main feed. It should be pointed out that it is practical for the thread end 46 to be sought and returned while fibre tuft 40 is being prepared.

It is practical to perform the piecing operation at a rotor speed which is lower than its normal operating speed; this can be performed while spinning rotor 5 is running up to its normal operating speed. This is accomplished by means of starting lever 34, which rests on free arm 17 of double lever 14 of brake 11. When free arm 17 of brake 11 is released, which is caused by the retraction of lifting magnet 32, starting lever 34 is actuated and, in turn, actuates a starting switch 52, which has a time-lag relay. Starting switch 52 is connected with a drive motor of auxiliary draw-off rollers 49 and 50 for performing the piecing operation, on the one hand, and with the auxiliary drive, on the other, through which supply roller 19 is driven in such a manner that its starting characteristic, and thus feed of sliver 18, corresponds to the desired requirements, i.e. the preliminary feed of the shortened fibres, followed by the main feed, which is altered in accordance with appropriate criteria relative to the normal operating feed.

The main drive of the sliver feed must remain off during this period of time, i.e. clutch 26 must remain open. This can be controlled by means of an electrical timing element, for example, which only closes clutch 26 after a delay, even if thread stop-motion 28 has been placed in its operating position again which, in the illustrated embodiment, is performed by means of a thread trapper 53 of maintenance unit 1, which offers the thread end 46 to the mouth of yarn removal channel 47. In the illustrated embodiment, it can be ensured, with the aid of additional switching means of maintenance unit 1, that clutch 26 remains open, so that the sophistication of the individual spinning units 2 remains small. For this purpose, switch 27 of thread stop-motion 28 is designed as a double switch, which can also be switched by a pusher 54 in such a manner that clutch 26 remains open. The pusher is reversed by means of a lever 55 of maintenance unit 1 associated to it, said lever 55 being switched with the aid of an electric servo element. This servo element, and thus lever 55, can be coupled electrically with thread trapper 53, so that swivelling thread stop-motion 28 into its operating position with the aid of thread trapper 53 results in actuation of pusher 54, so that clutch 26 remains open. After the piecing operation, clutch 26 is closed, thereby starting the main drive of the sliver feed. In order to avoid mutual damage to the auxliliary drive and the main drive, unillustrated freewheeling means are installed in the auxiliary drive. This also ensures that the transition of the sliver feed from the auxiliary drive to the main drive is uniform and smooth.

FIG. 2 shows an enlarged representation of the supply and opening means. Sliver 18 is advanced through a feed hopper 59 to supply roller 19, rotating in the direction of the arrow; supply roller 19 operates conjointly with a supply table 39, which can be pivoted about axle 56 and is subject to the force of a spring 57. Sliver 18 is trapped on a trapping line 64 extending in the axial direction of supply roller 19. Provided in supply table 39 is a channel 38, which is attached to a lateral line 58, to which lever 36, illustrated in FIG. 1, can be swivelled. This permits compressed air to be blown through channel 38 in the direction of arrow 60 against fibre tuft 40 by maintenance unit 1. This causes fibre tuft 40 to press against opener roller 20, rotating in the direction of the arrow, which shortens fibre tuft 40. If a stream of compressed air were not employed, fibre tuft 40 would come into a contacting relationship with opener roller 20 further downward, which would result in a longer fibre tuft. The compressed air is also blown in with supply roller 19 and spinning rotor 5 is stopped in order to be able to immediately exhaust the cut fibres. No compressed air is blown in during the subsequent preliminary feed for the piecing operation or for the subsequent main feed in order to maintain the normal staple length of the fed fibres. The airstream for preparing fibre tuft 40 also serves to clean the clothing of opener roller 20.

The embodiment according to FIG. 3 differs from the other embodiments in that a blade 63, which is rigidly attached to the machine and against which the stream of compressed air 60 can blow fibre tuft 40, is provided on the housing 62 which surrounds opener roller 20. This permits fibre tuft 40 to be cut even closer to trapping line 64, so that even shorter fibres can be supplied. The fibre tuft can, of course, also be advanced to the blade by mechanical means. It is also conceivable to arrange blade 63 on supply table 39. Moreover, it is also possible to have supply roller 19 run forward and backward briefly during the cutting operation or to have supply table 39 move forward and backward one or more times. In this embodiment, channel 38 of supply table 39 is attached to a collar 61, against which lever 36 of maintenance unit 1 can come into a contacting relationship. When fibre tuft 40 is shortened, it could possibly be removed from the area of opener roller 20 by a slight rearward rotation of supply roller 19.

The auxiliary means for separating and shortening the fibre tuft, and the actuating means intended therefor, can also be arranged on another maintenance unit, for example on a cleaning unit intended for cleaning the open-end spinning units, which precedes the maintenance unit performing the piecing operation. In this case, however, it is possible that somewhat different conditions would exist if the piecing operation had to be repeated in the event of an unsuccessful first attempt.

Obviously, many modifications and variations of the present invention are possible in the light of the above teachings. It should therefore be understood that within the scope of the appended claims, the invention may be practised otherwise than as specifically described.

Having thus fully disclosed my invention, what I claim is:

1. A method for piecing a thread on open-end spinning units, in which a thread is returned to a spinning rotor, placed on a ring of fibres deposited in said spinning rotor, and then drawn off again, in which said ring of fibres is formed from fibres removed from an opened sliver, with said sliver being offered to opening means by feed means in the form of a fibre tuft; further comprising:

shortening of a fibre tuft to form predetermined short fibres with said feed means switched off, switching said feed means on for producing a ring of shortened fibres in said spinning rotor, wherein the spinning rotor runs up from its stopped condition to its operating speed during the piecing operation, wherein the thread is placed on the ring of fibres before said spinning rotor reaches said operating speed, and wherein a quantity of fibres are fed at a rate which is smaller than the feed rate of fibres fed during normal operation until said thread is placed on said ring of fibres.

2. A method for piecing a thread on an open-end spinning unit of the type having a spinning rotor, comprising:

preparing shortened fibres, supplying said shortened fibres to said spinning rotor to form a ring of shortened fibres, returning a thread end to said ring of shortened fibres while rotating said spinning rotor to piece said thread end with said ring of shortened fibres, drawing off said thread, and supplying normal length fibres to said spinning rotor to form more thread following the piecing connection formed with said shortened ring of fibres, wherein said preparing and supplying of said shortened fibres are performed in a predetermined manner to form a predetermined configuration of said ring of shortened fibres, whereby uniform repetitive piecing operations are accommodated.

3. A method for piecing a thread on an open-end spinning unit of the type having a spinning rotor, comprising:

shortening fibres of a fibre tuft being supplied by feeding means, performing a first stage switching of said feeding means to feed the shortened fibres to said spinning rotor as a starting ring of shortened fibres for piecing with a thread end to be returned to the spinning rotor, and performing a second stage switching of said feeding means to feed fibres of normal length which are longer than said shortened fibres to said spinning rotor after said first stage switching.

4. A method according to claim 3, wherein said shortening of fibres is done with said feeding means in a stopped condition and includes holding of said fibre tuft at said feeding means while an opening means arranged downstream of said feeding means and upstream of said spinning rotor continuously operates to shorten fibres of said fibre tuft in a predetermined manner.

5. A method according to claim 3, wherein said first stage switching includes driving said feeding means with an auxiliary drive unit, and wherein said second stage switching includes driving said feeding means with a main drive unit at said spinning unit, said main drive unit being separate from and independently operable with respect to said auxiliary drive unit.

6. A method according to claim 4, wherein said first stage switching includes driving said feeding means with an auxiliary drive unit, and wherein said second stage switching includes driving said feeding means with a main drive unit at said spinning unit, said main drive unit being separate from and independently operable with respect to said auxiliary drive unit.

7. A method according to claim 3, wherein said shortening of fibres includes applying compressed air to blow said fibre tuft against an opener roller of said spinning unit.

8. A method according to claim 4, wherein said shortening of fibres includes applying compressed air to blow said fibre tuft against an opener roller of said spinning unit.

9. A method according to claim 6, wherein said shortening of fibres includes applying compressed air to blow said fibre tuft against an opener roller of said spinning unit.

10. A method according to claim 3, wherein said shortening of fibres includes applying compressed air to blow said fibre tuft against a blade at the housing for the opener roll of said spinning unit.

11. A method according to claim 6, wherein said shortening of fibres includes applying compressed air to blow said fibre tuft against a blade at the housing for the opener roll of said spinning unit.

12. A method according to claim 8, wherein said shortening of fibres includes applying compressed air to blow said fibre tuft against a blade at the housing for the opener roll of said spinning unit.

13. A method according to claim 4, wherein a thread end is returned to said spinning rotor to piece up with said ring of shortened fibres, and wherein said performing of said first stage switching is done at a predetermined time preliminary to said return of a thread end to said spinning rotor.

14. A method according to claim 5, wherein a thread end is returned to said spinning rotor to piece up with said ring of shortened fibres, and wherein said first stage switching is performed at a predetermined time preliminary to said return of a thread end to said spinning rotor.

15. A method according to claim 3, wherein said piecing is performed after a thread breakage at said spinning unit.

16. A method according to claim 6, wherein said piecing is performed after a thread breakage at said spinning unit.

17. The method according to claim 13, in which the spinning rotor runs up from its stopped condition to its operating speed during the piecing operation, and in which the thread is placed on the ring of shortened fibres before said spinning rotor reaches said operating speed.

18. The method according to claim 14, in which the spinning rotor runs up from its stopped condition to its operating speed during the piecing operation, and in which the thread is placed on the ring of shortened fibres before said spinning rotor reaches said operating speed.

* * * * *